US008240391B2

(12) United States Patent
Bouligny, Jr. et al.

(10) Patent No.: US 8,240,391 B2
(45) Date of Patent: Aug. 14, 2012

(54) SINGLE JOINT ELEVATOR WITH GRIPPING JAWS AND METHOD OF HOISTING A TUBULAR MEMBER

(75) Inventors: Vernon Joseph Bouligny, Jr., New Iberia, LA (US); Scott Joseph Arceneaux, Lafayette, LA (US)

(73) Assignee: Frank's Casing Crew and Rental Tools, Inc., Lafayette, LA (US)

( * ) Notice: Subject to any disclaimer, the term of this patent is extended or adjusted under 35 U.S.C. 154(b) by 0 days.

(21) Appl. No.: 11/746,123

(22) Filed: May 9, 2007

(65) Prior Publication Data

US 2008/0277108 A1 Nov. 13, 2008

(51) Int. Cl.
*E21B 19/10* (2006.01)

(52) U.S. Cl. ..... 166/382; 166/77.52

(58) Field of Classification Search ..... 166/77.51, 166/77.52, 77.53, 382; 175/85, 423; 294/91, 294/94, 95, 96, 102.2
See application file for complete search history.

(56) References Cited

U.S. PATENT DOCUMENTS

| | | | | |
|---|---|---|---|---|
| 1,211,999 | A | | 1/1917 | Arey et al. |
| 1,535,625 | A | | 4/1925 | O'Bannon |
| 1,548,337 | A | | 8/1925 | Smith |
| 1,656,582 | A | | 1/1928 | Harder |
| 1,754,288 | A | | 4/1930 | Smith |
| 1,766,920 | A | | 6/1930 | Moody |
| 2,009,942 | A | | 7/1935 | Moody |
| 3,776,320 | A | | 12/1973 | Brown |
| 3,846,877 | A | | 11/1974 | Spiri |
| 3,915,244 | A | | 10/1975 | Brown |
| 4,035,012 | A | | 7/1977 | Guier |
| 4,269,554 | A | | 5/1981 | Jackson |
| 4,275,487 | A | | 6/1981 | Gray et al. |
| 4,361,940 | A | | 12/1982 | McFadden |
| 4,441,749 | A | | 4/1984 | Blaschke et al. |
| 4,576,254 | A | * | 3/1986 | Cox ..... 188/67 |
| 4,579,379 | A | | 4/1986 | Berg |
| 4,604,724 | A | | 8/1986 | Shaginian et al. |
| 4,647,099 | A | | 3/1987 | Berry et al. |
| 4,676,312 | A | | 6/1987 | Mosing et al. |
| 4,867,236 | A | * | 9/1989 | Haney et al. ..... 166/77.51 |
| 4,986,146 | A | * | 1/1991 | Buck ..... 81/57.18 |
| 5,027,926 | A | | 7/1991 | Cox |
| 5,127,790 | A | | 7/1992 | Teague |

(Continued)

OTHER PUBLICATIONS

PCT/US2008/062910, International Search Report and Written Opinion dated Aug. 21, 2008. 11 pages.

(Continued)

*Primary Examiner* — David Andrews
(74) *Attorney, Agent, or Firm* — Osha Liang LLP

(57) ABSTRACT

Single joint elevator and method for releasably securing a tubular segment. A generally horseshoe-shaped body has a slot for receiving a tubular segment, and an actuator assembly that selectively moves opposing jaws from a removed position to a deployed position to grip and retain the tubular segment within the slot of the body while hoisting the body. The deployable jaws are either rotatably or translatably moved from the removed position to the deployed position and may be pneumatically, hydraulically, and/or electrically actuated. The actuator assembly may include wedges operatively coupled to actuators for selectively biasing the wedges against the jaws, or a cam ring rotationally coupled to the body and rotated by an actuator coupled between the body and the cam ring, wherein the cam ring has an inner cam surface for inwardly biasing the opposing jaws.

8 Claims, 3 Drawing Sheets

U.S. PATENT DOCUMENTS

| | | | |
|---|---|---|---|
| 5,299,848 | A | 4/1994 | Boyer |
| 5,340,182 | A | 8/1994 | Busink et al. |
| 5,791,410 | A | 8/1998 | Castille et al. |
| 5,909,768 | A | 6/1999 | Castille et al. |
| 6,568,479 | B2 | 5/2003 | Mosing et al. |
| 6,742,596 | B2 | 6/2004 | Haugen |
| 6,938,697 | B2 | 9/2005 | Haugen |
| 6,976,540 | B2 | 12/2005 | Berry |
| 6,997,265 | B2 | 2/2006 | Berry |
| 7,032,678 | B2 | 4/2006 | Mosing et al. |
| 2006/0185854 | A1 | 8/2006 | Mosing et al. |
| 2008/0136203 | A1 | 6/2008 | Krijnen et al. |

OTHER PUBLICATIONS

U.S. Patent and Trademark Office, "U.S. Appl. No. 11/624,771, Office Summary Action" dated Apr. 8, 2009, pp. 1-12.

"SJH Horizontal Pickup Elevator" National Oilwell Varco, 2008, 1072 Rev. 03 brochure.

PCT "International Preliminary Report on Patentability", Jul. 31, 2009, pp. 1-8.

PCT/US2008/062910, "PCT International Preliminary Report on Patentability", Nov. 10, 2009, 6 pages.

BJ "Single Joint Elevators—Type SJ Auxiliary Elevator—Type SP Auxiliary Elevator" p. 53.

* cited by examiner

SINGLE JOINT ELEVATOR WITH GRIPPING JAWS AND METHOD OF HOISTING A TUBULAR MEMBER

FIELD OF THE INVENTION

The present invention is directed to an apparatus and a method for securely gripping and releasing a tabular segment or stand of tubular segments for use in drilling operations, particularly for hoisting the tubular segment into alignment with a tubular string.

BACKGROUND OF THE RELATED ART

Wells are drilled into the earth's crust using a drilling rig. Tabular strings are lengthened by threadably coupling add-on tubular segments to the proximal end of the tubular string. The tabular string is generally suspended within the borehole using a rig floor-mounted spider as each new tubular segment or stand is coupled to the proximal end of the tubular string just above the spider. A single joint elevator is used to grip and secure the segment or stand to a hoist to lift the segment or stand into position for threadably coupling to the tubular string.

For installing a string of casing, existing single joint elevators generally comprise a pair of hinged body halves that open to receive a tubular segment and close to secure the tubular within the elevator. Elevators are specifically adapted for seeming and lifting tubular members having conventional connections. A conventional connection comprises an internally threaded sleeve that receives and secures an externally threaded end from each of two tubular segments to secure the segments in a generally abutting relationship. The internally threaded sleeve is first threaded onto the end of a first tubular segment to form a "box end." The externally threaded "pin end" of the second tubular segment is threaded into the box end to complete the connection between the segments. Typical single joint elevators have a circumferential shoulder that forms a circle upon closure of the hinged body halves. The shoulder of the elevator engages the tubular segment under a shoulder formed by the end of the sleeve and the tubular segment. However, conventional single joint elevators cannot grip a tubular segment having integral connections, because there is no sleeve to form a circumferential shoulder.

Conventional elevators are also difficult to use on tabular segments that are not conveniently accessible. For example, casing segments are often moved to the rig floor from a horizontal pipe rack and presented to the rig floor at a "V"-door. A conventional single joint elevator requires enough clearance to close the hinged body halves around the tubular segment. Depending on the length of the tubular and the proximity of the floor or other rig structures, there may be insufficient clearance around the circumference of the tubular segment for gripping with a conventional single joint elevator, often requiring repositioning of the casing segment so that the single joint elevator can grip the tubular segment. Even if repositioning of each segment takes only a few seconds, delays for repeatedly repositioning tubular segments in the V-door consume a substantial amount of rig time.

What is needed is a single joint elevator that is securable to a tubular at any position along the length of the tubular segment, and not only at the sleeve. What is needed is a single joint elevator that is adapted for securing to the tubular segment notwithstanding close proximity of the rig floor or other rig structure. What is needed is a single joint elevator that can grip and lift single tubular segments without repositioning the tabular segment. What is needed is a versatile single joint elevator that facilitates lifting both a tubular segment having integral connections and a tubular segment having conventional connections with a threaded sleeve received onto the end of a threaded tubular segment.

SUMMARY OF THE PRESENT INVENTION

The present invention is directed to a single joint elevator for gripping a tubular member. The single joint elevator comprises a body having a slot for receiving a tubular member. First and second opposing deployable jaws are movably coupled to the body within the slot and moveable between a removed position and a deployed position within the slot, where each jaw has at least one gripping surface for contacting the tubular member. An actuator assembly selectively moves the jaws from the removed position to the deployed position to grip and retain the tubular member within the slot of the body while hoisting the body. The gripping surface of the jaws may be selected from the group consisting of stationary gripping dies and slips. Optionally, the jaws may be outwardly biased, such as with a coil spring, to return to the removed position when the actuator assembly is not biasing the jaws inwardly.

In one embodiment, the actuator assembly includes a cam ring rotationally coupled to the body, and an actuator coupled between the body and the cam ring for imparting rotation of the cam ring, wherein the cam ring has an inner cam surface for inwardly biasing the first and second opposing jaws. The actuator is preferably selected from a linear actuator and a motor coupled to the cams ring through a rotary gear. Optionally, the actuator is a cylinder powered by a pressurized fluid, such as a double-acting cylinder, for forcibly rotating the cam ring between a removed position and a deployed position. The first and second jaws that are cammed by the inner cam surface may be pivotally or slidably coupled to the body.

In a further embodiment, the actuator assembly includes a first wedge operatively coupled to a first actuator for selectively biasing the first wedge between the body and the first jaw, and a second wedge operatively coupled to a second actuator for selectively biasing the second wedge between the body and the second jaw. The first and second actuators may be cylinders powered by a pressurized fluid, such a double-acting cylinder for forcibly moving the wedges back and forth between a removed position and a deployed position. The first and second jaws that engage the wedges may be pivotally or slidably coupled to the body.

The foregoing and other objects, features and advantages of the invention will be apparent from the following more particular description of a preferred embodiment of the invention, as illustrated in the accompanying drawings wherein like reference numbers represent like parts of the invention.

DETAILED DESCRIPTION OF THE PRESENT INVENTION

Figure 1:
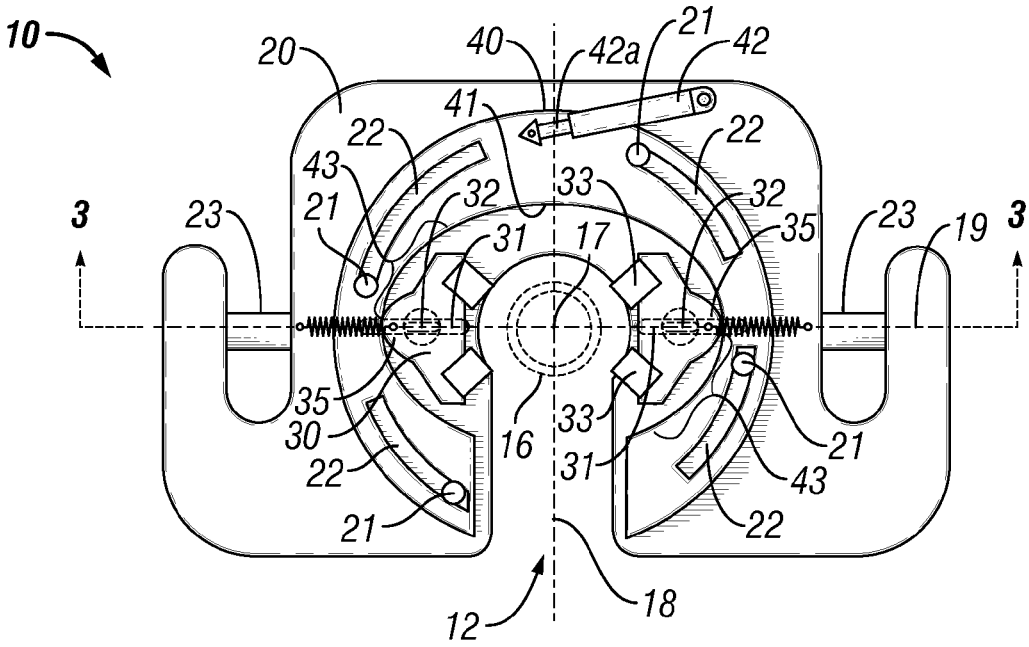
FIGS. 1-3 are top, side and cross-sectional views of one embodiment of a single joint elevator of the present invention having a cam ring that actuates jaws to grip a tubular segment.

The present invention is directed to a single joint elevator for releasably securing a tubular segment to a cable, rope, line or other hoisting member for lifting the tubular segment into position for being threadably coupled to a pipe string suspended in a borehole. One embodiment of the invention comprises a generally horseshoe-shaped body having a slot for receiving a tubular segment, and opposing jaws that deploy to grip the tubular segment within the slot of the body. The body is adapted for supporting the jaws, and also for being lifted and for transferring the weight of the tubular segment to a cable, rope, line or other hoisting member. An actuator assembly selectively moves the jaws from a removed position to a deployed position to grip and retain the tubular segment within the slot of the body while hoisting the body. Bach jaw has a removed position permitting entry of the tubular into the slot, and a deployed position to grip the tubular within the slot. The deployable jaw is either rotatably or translatably moved from its removed position to its deployed position and may be pneumatically, hydraulically, and/or electrically actuated.

The actuator assembly may include a first wedge operatively coupled to a first actuator for selectively biasing the first wedge between the body and the first jaw, and a second wedge operatively coupled to a second actuator for selectively biasing the second wedge between the body and the second jaw. Such an actuator assembly provides independent operation of the jaws. Alternatively, the actuator assembly may include a cam ring rotationally coupled to the body, and an actuator coupled between the body and the cam ring for imparting rotation of the cam ring, wherein the cam ring has an inner cam surface for inwardly biasing the first and second opposing jaws. Use of a cam surface allows for coordinated movement of the jaws using a single actuator, which may be a pressurized fluid-powered cylinder or a rotary gear coupled to a motor.

In one embodiment, an exemplary cam ring has a generally elliptical inner cam surface for symmetrically deploying the gripping jaws upon rotation of the cam ring in a first direction and releasing the jaws to retract upon rotation of the cam ring in the opposite direction. It should be recognized that a cam ring employing an elliptical cam surface can deploy the gripping jaws by rotation of the cam in either direction. The jaws are deployed when a minor axis of the cam surface ellipse is rotationally biased toward the jaw, because the jaw is restrained from rotating with the cam and is gradually biased toward the center of the ellipse. The jaws are able to move to a fully removed position when the cam is rotated to a point where the major axis of the ellipse is aligned with the jaws. The eccentricity of the cam surface effects both the maximum distance that the jaws can be moved together (i.e., the difference in the lengths of the between the major and minor axis) and also the amount of cam rotating force that will be transferred to the jaws as a gripping force. It should also be recognized that the cam surface does not need to be a true ellipse, but may have any profile that is designed to achieve sufficient jaw travel and gripping forces. Furthermore, the cam surface may be interrupted or fragmented, since it is anticipated that the cam ring will typically not be rotated more than about 45 degrees in either direction from the major axis. Furthermore, the cam surface does not need to be "double-acting" as an elliptical surface extending in either direction from the major axis, but could be "single acting" with a gradually reducing radial distance in only one rotational direction. A single acting cam ring should include a separate single acting cam surface for each jaw and should be pitched for coordinated simultaneous deployment with a single actuator. For example, even a continuous elliptical surface that has the potential to be "double-acting" will preferably have its rotation limited so that the cam surface functions as a single-acting cam surface. Rotational limits increase the accuracy and reliability of positioning the cam ring with the jaws in the fully removed position.

Each jaw is moveably supported by the body. Preferably, the jaws are either pivotally or slidably coupled to the body. Accordingly, the actuator assembly engages and biases the jaws to pivot or to slide from a removed position to a deployed position to grip the tubular.

Each deployable jaw preferably comprises a slip or gripping die. In one embodiment, gripping dies are pivotally secured to the jaw and rotating toward the tubular to tighten the grip. The jaws may have sloped-back inserts that are spring offset upward. Once the jaws have been energized against the tubular segment, the weight of the tubular segment will force the inserts downward and into the tubular wall. In another embodiment, each jaw comprise one or more grooves for slidably receiving tabs, keys, or guides for imposing a predetermined path for movement of a slip within the jaw. Each slip may comprises a contact surface, such as a removable insert or gripping die, which may comprise a textured surface adapted for gripping contact with the external wall of the tubular segment received into the slot.

As used herein, the term "single joint elevated" is intended to distinguish the elevator from a string elevator that is used to support the weight of the entire pipe string. Rather, a "single joint elevator" is used to grip and lift a tabular segment as is necessary to add or remove the tubular segment to or from a tubular string. Furthermore, a pipe or tubular "segment", as that term is used herein, is inclusive of either a single pipe or tubular joint or a stand made up of multiple joints of a pipe or other tubular that will be lifted as a unit. In the context of the present disclosure, a tubular segment does not include a tubular string that extends into the well.

FIG. 1 is a top view of one embodiment of a single joint elevator having a cam ring that actuates opposing jaws to grip a tubular segment. The single joint elevator 10 has a generally horseshoe-shaped body 20 that is securable to one or more cables, ropes, lines or other hoisting members (not shown) at a pair of generally opposed lugs 23 to facilitate lifting and positioning of the single joint elevator 10 and any tubular segment 16 secured therein. The lugs 23 may be removable and replaceable to facilitate securing the single joint elevator 10 to a loop formed in the end of a cable.

The body 20 has a slot 12 in one side for receiving the tubular segment 16 and supports a cam ring 40 for selective rotation generally about a axis 17 of the cam ring. The central axis of the cam ring 40 is preferably positioned to substantially intersect a centerline 18 of the slot 12 in order to receive the tubular segment generally centered within the cam ring 40. It is also preferable for the axis 17 of the cam ring 40 to be positioned to substantially intersect a line 19 extending between the lugs 23 so that once the concentrically received tubular segment has been gripped and lifted, the tubular segment will hang straight downward.

The cam ring 40 includes a plurality of slots 22, each slot having a constant radius of curvature about the axis of rotation 17. Each slot 22 slidably receives a post 21 that is fixedly secured to the body 20 and positioned to allow the cam ring 40 to rotate relative to the body 20, while preventing translation of the cam ring 40 relative to the body. It is preferable to limit the arc of the slot 22 to about 30 to 45 degrees in order to limit the extent to which the cam ring 40 will rotate relative to the body 20 and avoid weakening of the cam ring 40. One reason to limit rotation of the cam ring 40 is to prevent the possibility that over-rotation of the cam ring 40 will cause an unintended re-deployment of the jaws 30. Accordingly, it should be recognized that the slots 22 and posts 21 cooperate to allow only portions 43 of the inner cam surface 41 to operate and cam the jaws 30.

A cylinder 42 has a first end pivotally secured to the body 20 and a second end pivotally secured to the cam ring 40. Applying fluid pressure within the cylinder 42 causes the cylinder rod 42*a* to extend. Because the cam ring 40 is rotationally secured, the extension of the cylinder 42, as configured in FIG. 1 and viewed from the top, causes the cam ring 40 to rotate in a counter-clockwise direction about the axis of rotation 17 and move the jaws 30 to a deployed position (see FIG. 4). Subsequent retraction of the cylinder 42 causes the cam ring to rotate in the opposite, or clockwise direction back to the removed position shown in FIG. 1.

Figure 4:
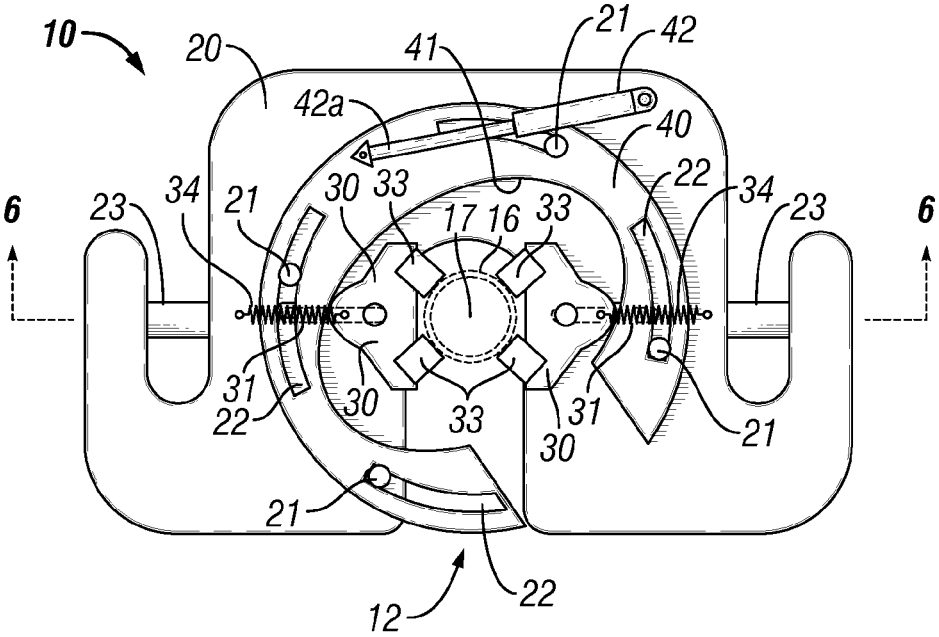
FIGS. 4-6 are top, side and cross-sectional views of the single joint elevator of FIGS. 1-3 with the cam ring rotated to an actuated position and the jaws gripping the tubular segment.

First and second jaws 30 are each slidably secured to the body 20 using a pin, tongue, or blade 32 that extends into a slot, groove, or track 31 in the body. The tracks 31 are directed toward the axis of rotation 17 to allow the jaw 30 to deploy between a removed position (as shown in FIG. 1) and a deployed position (with jaws 30 displaced one toward the other) to grip the pipe 16 (as shown in FIG. 4). Each jaw 30 includes one or more slips or other gripping members 33 secured to an inwardly facing surface of the jaw 30 for contacting and gripping the tubular segment. The outwardly lacing side of each jaw 30 forms a cam follower 35 that slidably engages the inner cam surface 41 of the cam ring 40.

Figure 2:
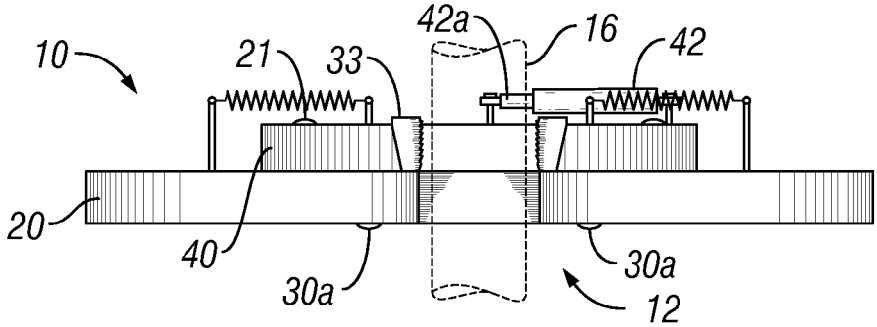

FIG. 2 is a front elevation view of the single joint elevator 10 having a cam ring 40 that rotates to actuate jaws 30 (See FIG. 1) to grip a tubular segment 16. The slotted body 20 and slotted cam ring 40 are shown in alignment to provide an open slot 12 for receiving a tubular segment 16.

Figure 3:
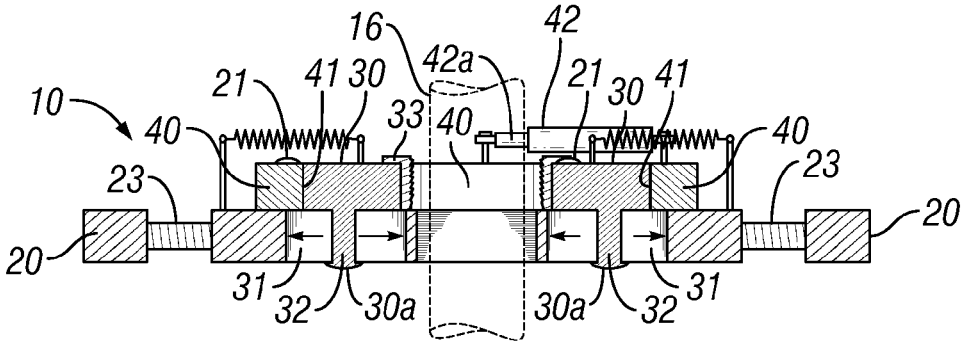

FIG. 3 is a front cross-sectional view of the single joint elevator 10 taken along line 3-3 in FIG. 1. This view highlights the lugs 23 for supporting the body 20 and the tubular gripped therein, and the slots or track 31 within the body 20 that slidably secure the jaws 30. Each jaw 30 includes a blade, tongue, or post 32 that is received in a slot, grove or track 31 and, in FIG. 3 is secured vertically by a head 30*a* that is larger than the width of the slot. This configuration allows the jaw 30 of FIG. 3 to slide along the path of the track 31 (left and right as shown in FIG. 3). While the jaw 30 is preferably prevented from) any large degree of rotation about its post 32 to avoid mis-engagement of the slips 33 against the tubular segment 16, a few degrees of permitted rotation may be desirable to allow the jaws to self-align with the tubular segment 16. A post 32 having a circular cross-section will enable rotation of the jaw 30 about the post, but this must be otherwise limited such as by the outward face of the jaw 30 being configured to engage the cam surface 41. Furthermore, the rotation of the jaw 30 can be limited by replacing post 32 with a blade that is longer than width of the track 31 so that the blade 32 can rotate only a few degrees within the track 31.

FIG. 4 is a top view of the single joint elevator 10 with the cam ring 40 rotated to a deployed position and the jaws 30 gripping the tubular segment 16. The cylinder 42 has been extended under fluid pressure to bias the cam ring 40 to rotate counter-clockwise relative to the body 20 about 35 degrees, wherein the rotation of the cam ring 40 is guided by the slots 22 slidably secured about the posts 21. This rotation of the cam ring 40 causes the inner cam surface 41 to push the jaws 30 along the tracks 31 inwardly toward the axis 17 until the slips 33 engage and grip the tubular segment 16. Continued application of fluid pressure to the cylinder 42 maintains this grip on the tubular segment 16 during handling of the tubular segment.

When the handling of the tubular segment has been completed, the single joint elevator 10 is released from the tubular segment 16 by retracting the cylinder 42 to the position of FIG. 1. Since the jaws 30 are then no longer biased inwardly by the cam surface 41, the jaws move away from the tubular segment to a removed position under the action of springs 34. The jaw 30 may be biased away from engagement with the tubular segment in other manners, such as by slidably coupling a "T"-shaped bar attached to the jaw 30 within a "T"-shaped receiving groove formed in the inner cam surface 41.

Figure 5:
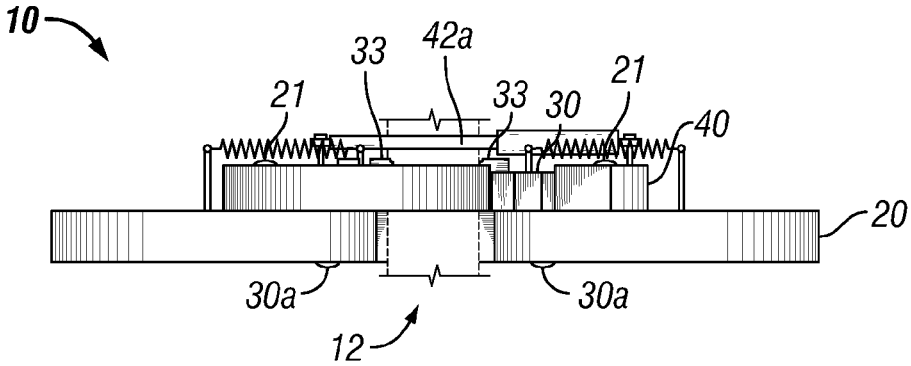

FIG. 5 is a side view of the single joint elevator 10 with the cam ring 40 rotated to an actuated position and the jaws 30 gripping the tubular segment 16. The slot in the cam ring 40 is now shown radially offset from the slot 12 in the body 20, such that the single joint elevator 10 is closed.

Figure 6:
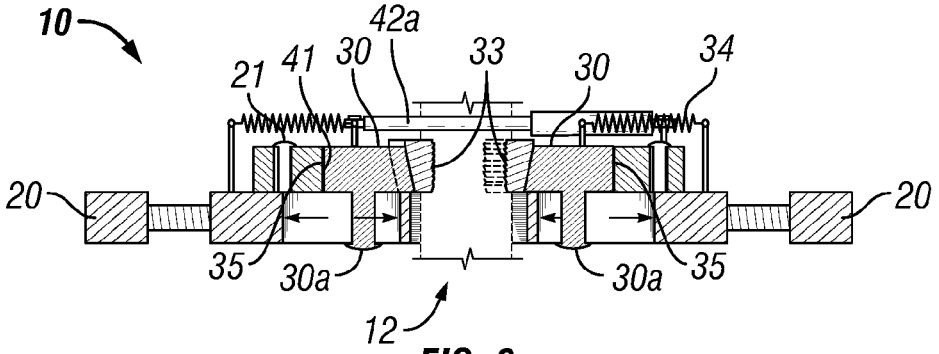

FIG. 6 is a cross-sectional view of the single joint elevator 10, taken along line 6-6 in FIG. 4. Counter-clockwise rotation of the cam ring 40 has caused the inner cam surface 41 to push the cam follower 35 of the jaws 30 inwardly toward to tubular segment 16. The post 32 has traveled inwardly along the track 31 with the cam rotated to an actuated position and the jaws 30 gripping the tubular segment.

Figure 7:
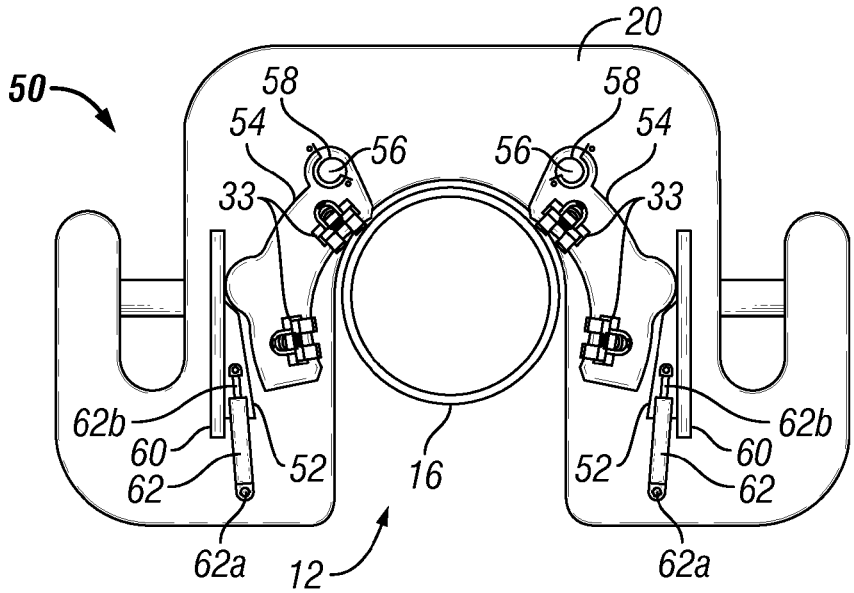
FIG. 7 is a top view of one embodiment of a single joint elevator of the present invention having wedges that actuate pivotable jaws toward a tubular segment.

FIG. 7 is a top view of a second embodiment of a single joint elevator 50 having translatably deployable wedges 52 that engage and actuate pivotable jaws 54 toward a tubular segment 16 received within the slots 12 of body 20. The body 20 pivotally secures first and second jaws 54 at pivots 56, which preferably include a coil spring 58 for biasing the jaws 54 toward the removed position (as shown in FIG. 7). With the jaws 54 in the removed position, the slot 12 may receive a tubular segment 16 without the jaws 54 either blocking the slot or being in a position to be hit as the tubular segment 16 is received. The wedges 52 are slidably secured between the back of the jaws 54 and backing stops 60. Cylinders 62 secured to the body 20 at pins 62*a* may be used to selectively bias the wedges 52 between retracted and extended positions to move the wedges 52 between removed (see FIG. 7) and deployed (see FIG. 8) positions, respectively. While the cylinders 62 may be independently controlled with fluid pressure, the cylinders are preferably actuated simultaneous by providing them on the same fluid power line.

Figure 8:
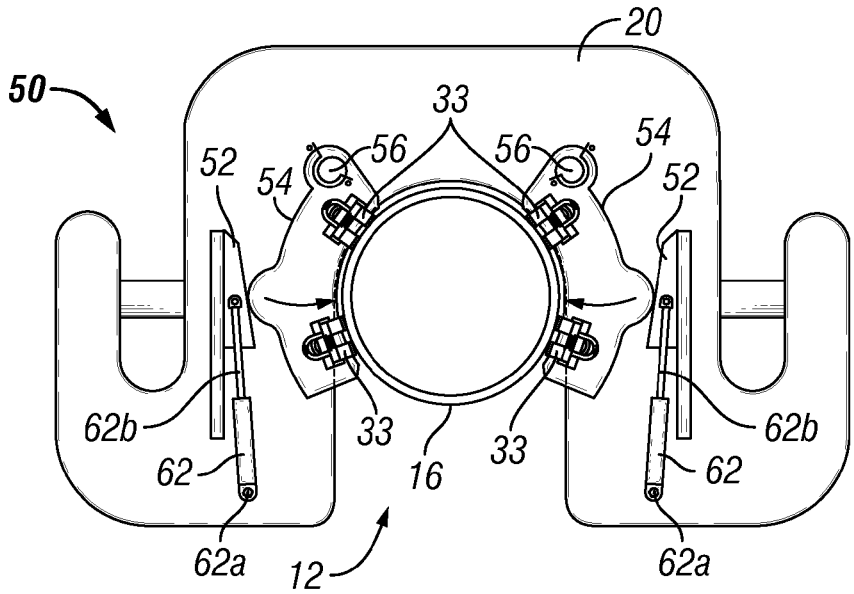
FIG. 8 is a top view of the single joint elevator of FIG. 7 with the wedges actuated to pivot the jaws into gripping engagement of the tubular segment.

FIG. 8 is a top view of the single joint elevator 50 of FIG. 7 with the wedges 52 extended to pivot the jaws 54 about the pivots 56 and bias the jaws 54 into gripping engagement of the tabular segment 16. The slips 33 on the jaws 54 are arranged to contact and grip the outer surface of the tubular segment. Continued application of fluid pressure to the cylinders 62 maintains this grip on the tubular segment 16 during handling of the tubular segment. Alternately, the cylinder rods 62*b* or the wedges 52 may be mechanically locked into the deployed condition using a latch to maintain the grip on the tubular segment 16 even if the hydraulic pressure is lost or reduced.

When the handling of the tubular segment has been completed, the single joint elevator 50 is released from the tubular segment 16 by retracting the cylinder 62 to the position of FIG. 7. Since the jaws 54 are then no longer biased inwardly by the wedges 52, the jaws move away from the tubular segment to a removed position under the action of springs 34. The jaw may be biased away from the tubular segment in various ways, but a coil spring 56 is easily implemented.

The terms "comprising," "including," and "having," as used in the claims and specification herein, indicate an open group that includes other elements or features not specified. The term "consisting essentially of," as used in the claims and specification herein, indicates a partially open group that includes other elements not specified, so long as those other elements or features do not materially alter the basic and novel characteristics of the claimed invention. The terms "a," "an" and the singular forms of words include the plural form of the same words, and the terms mean that one or more of something is provided. The terms "at least one" and "one or more" are used interchangeably.

The term "one" or "single" shall be used to indicate that one and only one of something is intended. Similarly, other specific integer values, such as "two," are used when a specific number of things is intended. The terms "preferably," "preferred," "prefer," "optionally," "may," and similar terms are used to indicate that an item, condition, or step being referred to is an optional (not required) feature of the invention.

It should be understood from the foregoing description that various modifications and changes may be made in the preferred embodiments of the present invention without departing from its true spirit. The foregoing description is provided for the purpose of illustration only and should not be construed in a limiting sense. Only the language of the following claims should limit the scope of this invention.

What is claimed is:

1. A method of hoisting a tubular, the method comprising the steps of:

providing a body having a slot in a side of the body to laterally receive the tubular within the body, at least one deployable jaw movably coupled to the body, and a cam ring having a slot coupled to the body to rotate about an axis from a retracted position with the slot of the cam ring aligned with the slot in the side of the body to an offset position with the slot of the cam ring not aligned with the slot in the side of the body;

rotating the cam ring to align the slot in the cam ring with the slot in the side of the body;

receiving the tubular into the aligned slots of the cam ring and the body;

rotating the cam ring to the offset position to move the at least one deployable jaw from a removed position to a deployed position to grip the tubular such that the at least one deployable jaw supports the weight of the tubular; and hoisting the body and the tubular using a hoist.

2. The method of claim 1 further comprising the step of:

restraining the cam ring from rotation beyond the offset position in a first direction of rotation.

3. The method of claim 1 further comprising the step of:

positioning the tubular into alignment with a second tubular using the hoist.

4. The method of claim 1 further comprising the step of:

coupling a slip on at least one deployable jaw to move with the at least one deployable jaw between the retracted position and the engaged position of the at least one deployable jaw;

wherein the slip tightens a grip on the tubular when the tubular is hoisted.

5. The method of claim 4 further comprising the step of:

biasing the slip to the retracted position.

6. The method of claim 4 further comprising the steps of:

engaging the tubular with the slip; and moving the body generally about the axis of rotation of the cam ring and relative to the tubular to move the at least one deployable jaw from the retracted position to the engaged position.

7. The method of claim 1 wherein the step of hoisting the body and the tubular using a hoist comprises the step of:

coupling a lug connected to the body to at least one of a cable, rope and line that is coupled to the hoist.

8. The method of claim 1 wherein the at least one deployable jaw is at least one of slidably coupled and movably coupled to the body.

* * * * *